US010732537B2

(12) United States Patent
Fujioka

(10) Patent No.: US 10,732,537 B2
(45) Date of Patent: Aug. 4, 2020

(54) IMAGE FORMING APPARATUS

(71) Applicant: CANON KABUSHIKI KAISHA, Tokyo (JP)

(72) Inventor: Ryota Fujioka, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/421,567

(22) Filed: May 24, 2019

(65) Prior Publication Data

US 2019/0278195 A1 Sep. 12, 2019

Related U.S. Application Data

(63) Continuation of application No. PCT/JP2017/043896, filed on Nov. 30, 2017.

(30) Foreign Application Priority Data

Dec. 1, 2016 (JP) ..... 2016-234191

(51) Int. Cl.
*G03G 15/06* (2006.01)
*G03G 15/11* (2006.01)
(Continued)

(52) U.S. Cl.
CPC ..... *G03G 15/065* (2013.01); *G03G 15/00* (2013.01); *G03G 15/06* (2013.01); *G03G 15/10* (2013.01); *G03G 15/11* (2013.01)

(58) Field of Classification Search
CPC ..... G03G 15/065; G03G 15/10–11
See application file for complete search history.

(56) References Cited

U.S. PATENT DOCUMENTS 8,792,796 B2 7/2014 Kella et al.
2010/0129120 A1* 5/2010 Senda ..... G03G 15/0815 399/264

(Continued)

FOREIGN PATENT DOCUMENTS

JP 2010-526338 A 7/2010
JP 2015-055778 A 3/2015

OTHER PUBLICATIONS

PCT International Search Report and Written Opinion dated Feb. 13, 2018, in PCT/JP2017/043896.

*Primary Examiner* — Carla J Therrien
(74) *Attorney, Agent, or Firm* — Venable LLP

(57) ABSTRACT

An image forming apparatus detects a current flowing between a developer carrying member and a cleaning member is detected for each of a plurality of toner images when a region on the developer carrying member passes through the cleaning member, and a potential difference to be used during image formation between the developing voltage and an image portion potential is set on the basis of a value of the detected current for each of the plurality of toner images. An absolute value of the potential difference to be used during image formation is larger than the potential difference between the developing voltage and the image portion potential whose absolute value is smallest among potential differences between the developing voltage and the image portion potential to be used for developing a toner image of which the value of the current detected is in a predetermined range among the plurality of toner images.

9 Claims, 7 Drawing Sheets

(51) Int. Cl.
*G03G 15/00* (2006.01)
*G03G 15/10* (2006.01)

(56) References Cited

U.S. PATENT DOCUMENTS

2010/0296825 A1* 11/2010 Kella ..... G03G 15/105
399/31
2013/0101304 A1* 4/2013 Sasaki ..... G03G 15/5033
399/49
2015/0071665 A1 3/2015 Lam et al.

* cited by examiner

IMAGE FORMING APPARATUS

This application is a continuation of PCT Application No. PCT/JP2017/043896, filed on Nov. 30, 2017.

TECHNICAL FIELD

The present invention relates to an electrophotographic image forming apparatus for forming an image with a liquid developer.

BACKGROUND ART

Conventionally, the image forming apparatus in which an electrostatic latent image formed by exposing a charged surface of a photosensitive drum to light is developed into a toner image by using a liquid developer containing particulate toner and a carrier liquid, and the toner image developed from the electrostatic latent image is transferred onto a recording material has been known. The liquid developer is accommodated in a mixer, and is supplied from the mixer to a developing device and is used for development. Then, the liquid developer which is not used for development is collected from the developing device into the mixer, and is supplied from the mixer to the developing device again and is used again. In the developing device, by the liquid developer carried on a rotating developing roller, the electrostatic latent image formed on the photosensitive drum is developed into the toner image. Such development of the electrostatic latent image into the toner image is carried out by movement of the charged toner in a liquid layer of the liquid developer formed between the developing roller and the photosensitive drum (so-called electrophoresis).

Incidentally, a charge amount of one particle of the toner (hereinafter, this is referred to as a toner charge amount) becomes larger with an increasing surface area of the toner. Further, mobility, i.e., ease of movement of the toner in the liquid developer is proportional to the toner charge amount. Further, toners different in particle size are contained in the liquid developer. For that reason, when compared with the toner having a relatively small particle size, the toner having a relatively large particle size is easily used preferentially for development. Therefore, with progress of image formation, a ratio of the toner having the small particle size increases in the liquid developer circulating between the mixer and the developing device. However, when the ratio of the toner having the small particle size excessively increases, although a toner concentration (a ratio of the toner occupied in a total weight of the liquid developer, TD ratio) of the liquid developer is proper and the toner amount in the liquid developer is sufficient, the electrostatic latent image is liable to be developed into the toner image low in image density.

Therefore, an image forming apparatus in which toners with different particle sizes in a larger amount are used for development by enhancing development efficiency has been proposed (Patent Document 1). Here, the development efficiency is a ratio of an amount of the toner with which the electrostatic latent image is developed on the photosensitive drum to an amount of the toner in the liquid developer, and a developing property becomes higher with higher development efficiency, i.e., the electrostatic latent image is developed into the toner image with a high density. In an apparatus described in Japanese Laid-Open Patent Application 2015-55778, the toner charge amount is adjusted by charging the liquid developer carried on the developing roller by a charger, whereby the electrostatic latent image can be developed into the toner image with high development efficiency.

However, in the case where a state of the liquid developer changes with progress of image formation or an ambient environment such as a temperature or a humidity change, a charge state of the toner is influenced, so that the toner charge amount can change. In that case, in the apparatus described in Japanese Laid-Open Patent Application 2015-55778, it becomes difficult to properly adjust the toner charge amount. In that case, the high development efficiency cannot be maintained and a ratio of the toner having the small particle size in the liquid developer increases, and sooner or later, the developing property lowers and the electrostatic latent image is developed into the toner image with a low image density. Further, the apparatus has to be upsized in order to ensure a space in which the charger is provided, and this is contrary to a recent demand for downsizing and it is difficult to employ the apparatus also from the viewpoint of a cost.

An object of the present invention is to provide an image forming apparatus capable of developing an electrostatic latent image into a toner image while maintaining high development efficiency in a simple constitution and thus capable of suppressing the development of the electrostatic latent image into the toner image low in image density.

Means for Solving the Problem

An image forming apparatus according to the present invention includes a rotatable image bearing member; a charging means for electrically charging a surface of the image bearing member to a second potential; an exposure portion for exposing the charged image bearing member to light to form an electrostatic latent image; a developer carrying member, rotatable while carrying a liquid developer containing toner and a carrier liquid, for developing the electrostatic latent image formed on the image bearing member with the liquid developer into a toner image by application of a developing voltage; a voltage applying means for applying the developing voltage to the image bearing member; a cleaning means capable of removing the toner, remaining on the developer carrying member after development, by application of a removing voltage; a current detecting means for detecting a current flowing between the developer carrying member and the cleaning means; and a controller capable of executing, during non-image formation, a setting mode for setting a developing contrast to be used during image formation, on the basis of a value of a current detected by the current detecting means under application of a predetermined voltage to a region in which a plurality of electrostatic latent images for detection are developed into toner images by constituting the developing contrast which is a potential difference between an exposure portion potential of the image bearing member exposed to light by the exposure means and the developing voltage.

Effect of the Invention

According to the present invention, the image forming apparatus capable of developing the electrostatic latent image into the toner image while maintaining the high development efficiency in the simple constitution and thus capable of suppressing the development of the electrostatic latent image into the toner image low in image density.

EMBODIMENTS FOR CARRYING OUT THE INVENTION

First Embodiment

Figure 1:
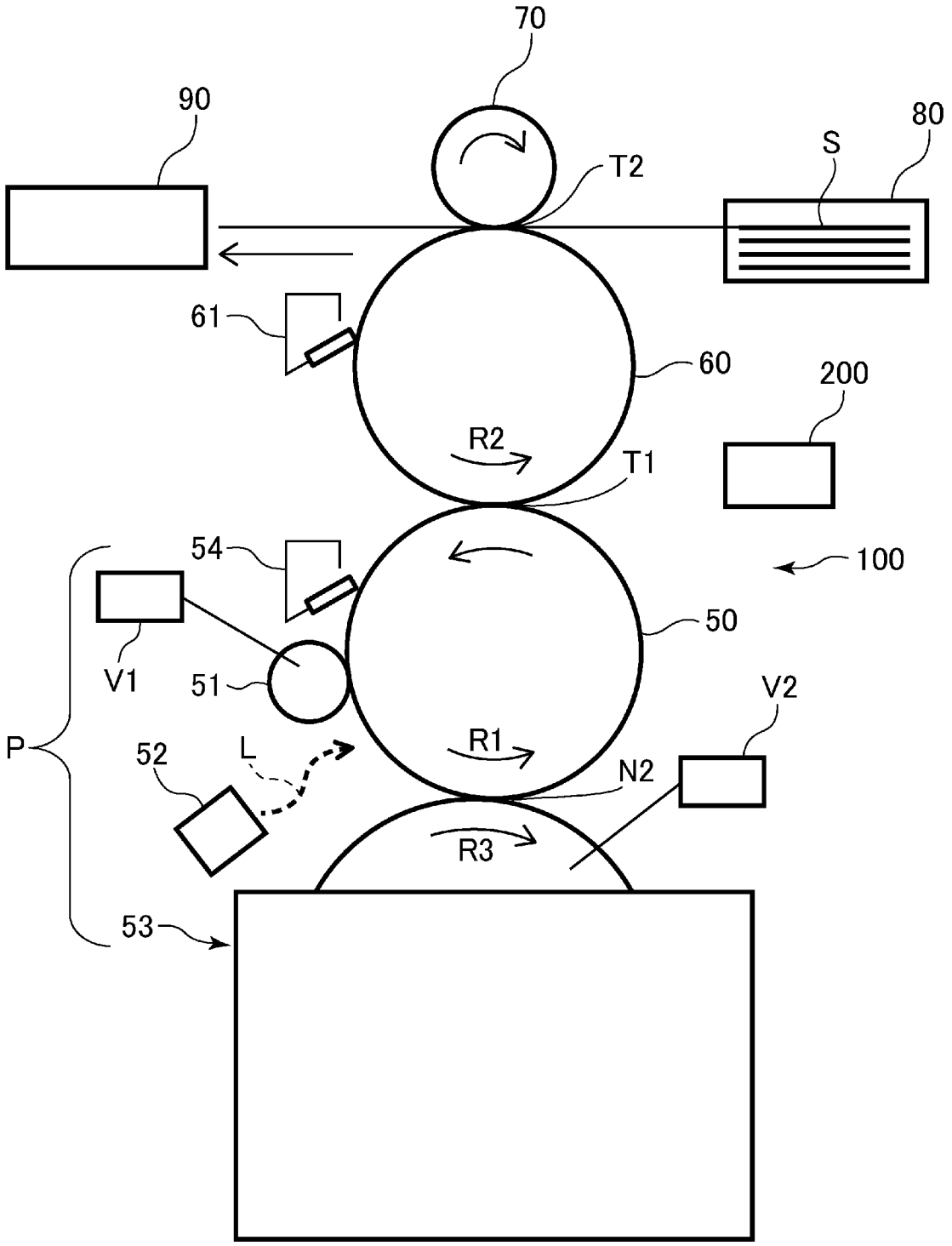
FIG. 1 is a schematic view showing a structure of an image forming apparatus of this embodiment.

A schematic structure of an image forming apparatus in this embodiment will be described using FIG. 1. An image forming apparatus 100 shown in FIG. 1 is a printer of an intermediary transfer type in which a single image forming portion P is provided. Here, for easy understanding, the printer including the single image forming portion P was shown, but, for example, the image forming apparatus 100 may also be a full-color printer of a tandem type in which respective colors of yellow, magenta, cyan and black are arranged and disposed in a rotational direction of an intermediary transfer drum 60.

[Image Forming Apparatus]

The image forming apparatus 100 is capable of outputting, to a recording material S (for example, a sheet, an OHP sheet and the like), an image formed depending on image information from an unshown external host device, such as a personal computer or an image reading device, communicable with an apparatus main assemble. In the image forming apparatus 100, a toner image on a photosensitive drum formed at the image forming portion P is primary-transferred onto the intermediary transfer drum 60, and thereafter, the toner image on the intermediary transfer drum 60 is secondary-transferred onto a recording material S fed from a cassette 80. The recording material S on which the toner image is thus transferred is fed to a fixing device 90, and when the recording material S is subjected to heating and pressing or to ultraviolet irradiation by the fixing device 90, the toner image is fixed on the recording material S. The recording material S on which the toner image is fixed is discharged to outside of the image forming apparatus.

[Image Forming Portion]

At the image forming portion P, a charging roller 51, an exposure device 52, a developing device 53 and a first cleaning device 54 are provided so as to encircle a photosensitive drum 50. The photosensitive drum 50 as an image bearing member is an organic photoconductor (OPC) drum in which an amorphous silicon type photosensitive layer is formed on an outer peripheral surface of an electroconductive cylinder made of aluminum and further preferably, a protective layer of a silicone resin type is formed on the photosensitive layer. The photosensitive drum 50 is rotated in an arrow R1 direction in the figure at a predetermined process speed (for example, a peripheral speed of 350 mm/sec) by an unshown driving motor.

The charging roller 51 as a charging portion electrically charges the surface of the photosensitive drum 50 to a uniform negative(-polarity) dark portion potential. That is, the charging roller 51 charges the surface of the rotating photosensitive drum 50 to a predetermined potential by application of a DC voltage from a charging voltage source v1. In this embodiment, the surface of the photosensitive drum 50 is uniformly charged to a surface potential (dark portion potential) of, for example, −500 V by the charging roller 51 during image formation. Here, during image formation is the time when the toner image is formed on the photosensitive drum 50 on the basis of image information inputted from an unshown external host terminal provided in the image forming apparatus. Incidentally, the charging roller 51 is not limited to the charging roller 51, but a corona charger of a non-contact charging type or the like may also be used.

The photosensitive drum 50 is uniformly charged to a predetermined polarity and a predetermined potential by the charging roller 51, and thereafter, is subjected to image exposure with laser light L from the exposure device 52 as an exposure means. That is, the exposure device 52 subjects the surface of the charged photosensitive drum 50 to laser scanning exposure by scanning the photosensitive drum surface through a rotating mirror with the laser light modulated correspondingly to an image signal sent from the unshown host device to the image forming apparatus 100. By this laser scanning exposure, potential of a portion (exposed portion) irradiated with the laser light L on the photosensitive drum lowers, so that on the rotating photosensitive drum, an electrostatic latent image which is subjected to the scanning exposure and which corresponds to the image information is formed. In the case of this embodiment, an exposed portion potential (light portion potential, image potential) of the photosensitive drum 50 is −150 V, for example.

The developing device 53 is disposed on a side opposite from the intermediary transfer drum 60 while sandwiching the photosensitive drum 50 therebetween. The electrostatic latent image formed on the photosensitive drum 50 is developed into the toner image with a liquid developer by the developing device 53. Although description will be specifically made later (see FIG. 2), a liquid layer of the liquid developer is formed between the developing device 53 (specifically, a developing roller described later) and the photosensitive drum 50 by supplying the liquid developer from the developing device 53 to the photosensitive drum 50, so that development of the electrostatic latent image into the toner image is enabled through the liquid layer.

In the developing device 53, the liquid developer in which particulate toner which is a dispersoid is dispersed in a carrier liquid which is a dispersion medium is accommodated. The toner is resin toner in which a colorant and a binder are main components, and a charge-assisting agent or the like is added. The toner is formed in, for example, about 1 μm in average particle size. On the other hand, the carrier liquid is a non-volatile liquid having a high resistance and low dielectric constant, and is adjusted so as to be, for example, 1E+9 Ω·cm or more in volume resistivity, 10 or less in relative dielectric constant, and 0.1-100 cP in viscosity. As the carrier liquid, a carrier liquid prepared by using, as a main component, an insulative solvent such as silicone oil, mineral oil, Isopar M (registered trademark, manufactured by Exxon Mobil Corp.) and by adding a charge control agent or the like into the insulative solvent, as needed is usable. Further, a liquid monomer curable with ultraviolet radiation or the like can also be used with a range of the above-described physical properties. In this embodiment, the liquid developer in which a weight percentage concentration of the toner in the liquid developer was adjusted to 1-10% was used. Further, in the liquid developer, the charge control agent which imparts negative electric charges to the toner surface is contained. The toner charge amount changes by adjusting a content of the charge control agent in the liquid developer.

As the charge control agent, a well-known compound can be used. As a specific example, it is possible to use fats and oils such as linseed oil and soybean oil; alkyd resin; halogen polymer, oxidative condensates such as aromatic polycarboxylic acid, acidic group-containing water-soluble dye and aromatic polyamine; metallic soaps such as cobalt naphthanate, nickel naphthanate, iron naphthanate, zinc naphthanate, cobalt octylate, nickel octylate, zinc octylate, cobalt dodecylate, nickel dodecylate, zinc dodecylate, aluminum stearate, and cobalt 2-ethylhexylate; sulfonic acid metal salts such as petroleum acid metal salt and metal salt of sulfosuccinic acid; phospholipid such as lectithin; salicylic acid metal salt such as t-butylsalicylic acid metal complex; polyvinyl pyrrolidone resin; polyamide resin; sulfonic acid-containing resin; and hydroxybenzoic acid derivative.

The intermediary transfer drum 60 which is an intermediary transfer member is disposed opposed to the photosensitive drum 50, and contacts the photosensitive drum 50 and forms a primary transfer portion T1 of the toner image. A positive(-polarity) primary transfer voltage (for example, 300 V) is applied to the intermediary transfer drum 60 by an unshown high voltage source, so that the toner image charged to the negative polarity on the photosensitive drum 50 is capable of being transferred onto the intermediary transfer drum 60. At the primary transfer portion T1, the liquid developer is supplied from the photosensitive drum 50 to the intermediary transfer drum 60, so that the toner transfer is enabled through the liquid layer of the liquid developer formed between the photosensitive drum 50 and the intermediary transfer drum 60. The first cleaning device 54 collects primary transfer residual toner remaining on the photosensitive drum after primary transfer by rubbing the photosensitive drum 50 with a cleaning blade. At this time, the first cleaning device 54 removes a carrier liquid together with the primary transfer residual toner from the photosensitive drum 50 and discharges the carrier liquid and the primary transfer residual toner into an unshown waste liquid tank.

A secondary transfer roller 70 is disposed on a side opposite from the photosensitive drum 50 while sandwiching the intermediary transfer drum 60 therebetween. The intermediary transfer drum 60 contacts the secondary transfer roller 70 and forms a secondary transfer portion T2 which is a toner image transfer nip (portion) onto the recording material S. The secondary transfer roller 70 is rotated so that the surface thereof is rotated in the same direction as the surface of the intermediary transfer drum 60 in the secondary transfer portion T2. In the secondary transfer portion T2, a secondary transfer voltage (for example, 1500 V) is applied to the secondary transfer roller 70 by an unshown high voltage source, so that the toner image is secondary-transferred from the intermediary transfer drum 60 onto the recording material S. At this time, the recording material S is fed to the secondary transfer portion T2 in synchronism with passing of the toner image, primary-transferred on the intermediary transfer drum 60, through the secondary transfer portion T2. Secondary transfer residual toner remaining on the intermediary transfer drum 60 after secondary transfer is collected by rubbing the intermediary transfer drum 60 by a second cleaning device 61. At this time, the second cleaning device 61 removes the carrier liquid together with the secondary transfer residual toner from the intermediary transfer drum 60, and discharges the carrier liquid and the secondary transfer residual toner into an unshown waste liquid tank.

[Developing Device]

Figure 2:
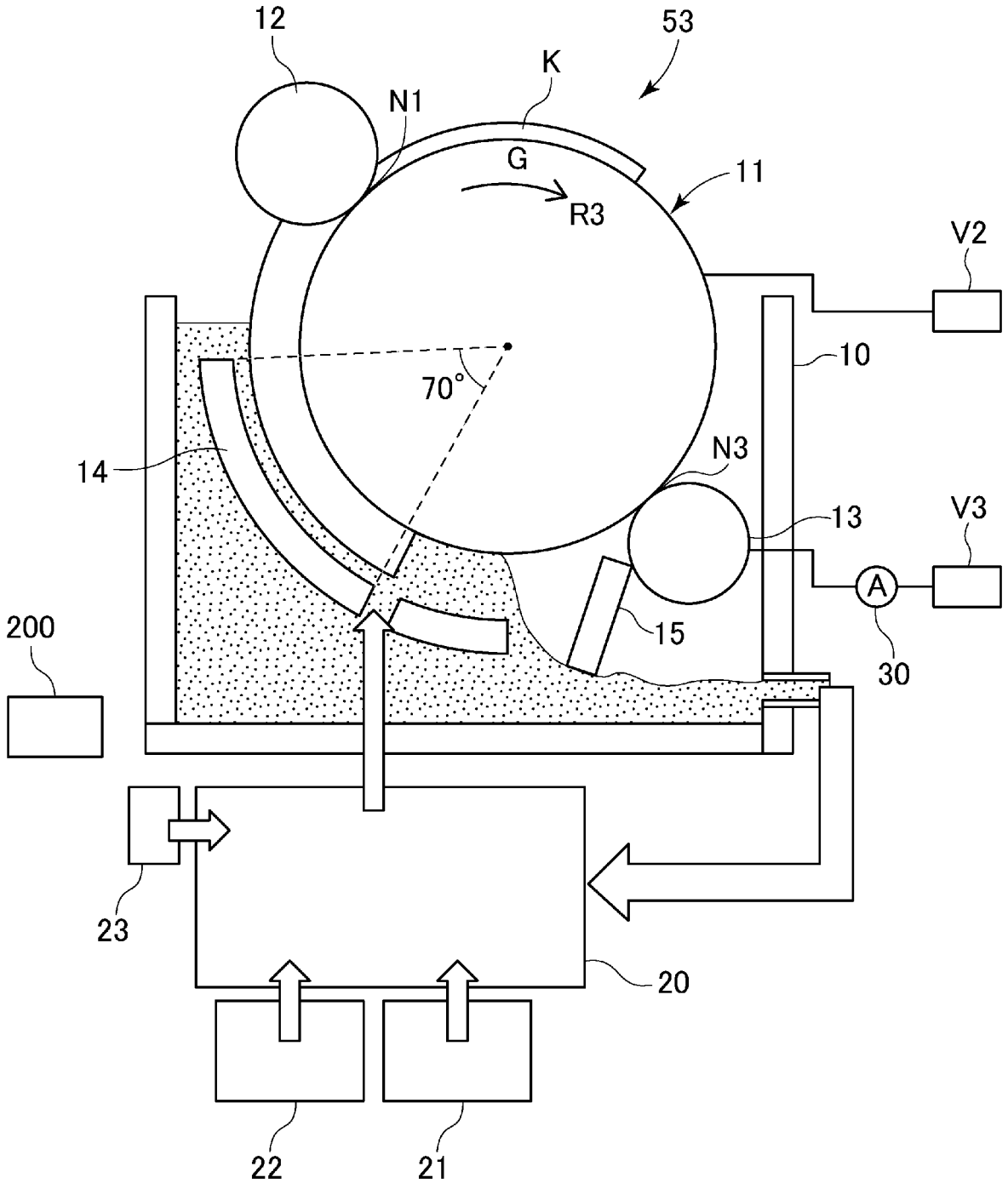
FIG. 2 is a sectional view showing a structure of an image forming portion.

A constitution and a developing operation of the developing device 53 will be described using FIG. 2 while making reference to FIG. 1. As shown in FIG. 2, the developing device 53 includes a developer container 10 forming a casing, a developing roller 11, a squeeze roller 12, a cleaning roller 13, an electrode segment 14 and the like.

In the developer container 10, the liquid developer is accommodated. The developer container 10 opens at an upper portion thereof opposing the photosensitive drum 50, so that at this opening, the developing roller 11 is rotatably provided so as to be exposed at a part thereof. The developing roller 11 as a developer carrying member is rotated in the same direction as the photosensitive drum 50 at an opposing surface to the photosensitive drum 50 (arrow R3 direction). The developing roller 11 is formed by an ester-based urethane rubber, for example. On a side upstream of the opposing surface of the developing roller 11 to the photosensitive drum 50 with respect to a rotational direction of the developing roller 11, the electrode segment 14 is disposed opposed to the developing roller 11 with a gap which is a predetermined interval (for example, 0.5 mm) between the electrode segment 14 and the developing roller 11. The liquid developer is drawn up into the above-described gap by a rotational force of the developing roller 11. In the case of this embodiment, the electrode segment 14 is disposed so that an angle of elevation thereof is a section opposing the developing roller 11 as seen from a center of the developing roller 11 is 70 degrees, for example.

The electrode segment 14 forms an electric field between itself and the developing roller 14 by application of a voltage of, for example, −500 V by an unshown voltage source. In accordance with this electric field, the toner contained in the liquid developer drawn up into the above-described gap shifts toward a surface side of the developing roller 11. On a side downstream of the electrode segment 14 with respect to the rotational direction of the developing roller 11, the squeeze roller 12 is disposed. The squeeze roller 12 forms a nip (portion) N1 in contact with the developing roller 11. Of the liquid developer on the developing roller 11 passed through an opposing region to the electrode segment 14, the toner shifted toward the second side of the developing roller 11 and a part of the carrier liquid pass through the N1 of the squeeze roller 12. A liquid layer K of the liquid developer formed on the developing roller surface passed through the nip N1 is regulated so that a thickness (a height with respect to a radial direction of the developing roller) is substantially uniform. The liquid developer which does not pass through the nip N1 of the squeeze roller 12 is returned to the liquid developer accommodated in the developer container 10. Incidentally, to the squeeze roller 12, a voltage of, for example, −400 V is applied by an unshown voltage source. The squeeze roller 12 is formed by, for example, a stainless steel (SUS) which has substantially no electric resistance, but may also be formed of a material other than SUS when the material has a similar electric characteristic. Further, the squeeze roller 12 is formed so that surface roughness (Rz) thereof is 0.1 μm or less. This is because the liquid developer (principally the carrier liquid) in a proper amount can be carried when the liquid developer passes through the nip N1 and because a uniform layer of the toner is formed on the liquid layer K of the liquid developer after passing thereof through the nip N1.

To the developing roller 11, in a state of being contacted to the photosensitive drum 50, a developing voltage of, for example, −300 V is applied by a developing voltage source V2 as a voltage applying means. In this embodiment, depending on the developing voltage applied by the developing voltage source V2, a developing contrast which is a potential difference between the exposed portion potential (image portion potential) of the photosensitive drum 50 and the developing voltage is changed. For example, in the case where the exposed portion potential is −150 V and the developing voltage is −300 V, the developing voltage is 150 V (absolute value, the same shall apply hereinafter). In a state in which the developing voltage is applied to the developing roller 11, when the liquid developer passed through the nip N1 of the squeeze roller 12 is fed to a developing position G, the electrostatic latent image on the photosensitive drum is developed into a toner image. That is, the liquid developer conveyed to the developing position G by the developing roller 11 is conveyed by the developing roller 11 and the photosensitive drum 50, and is divided into a liquid developer on the developing roller side and a liquid developer on the photosensitive drum side, and thus a liquid layer of the liquid developer is formed also on the photosensitive drum 50. Specifically, a part of the carrier liquid of the liquid developer is principally moved from the developing roller side to the photosensitive drum side. Further, the toner in the liquid developer conveyed to the developing position G is selectively deposited through the liquid layer of the liquid developer correspondingly to the electrostatic latent image formed on the photosensitive drum 1, by an electric field by the developing voltage. Thus, the electrostatic latent image on the photosensitive drum 50 is developed into the toner image. Incidentally, the developing position G is a developing nip (portion) N2 (see FIG. 1), formed by the developing roller 11 and the photosensitive drum 50.

On a side downstream of the developing position G with respect to the rotational direction of the developing roller 11, the cleaning roller 13 as a cleaning member is disposed. The cleaning roller 13 is formed by a stainless steel (SUS), for example. The cleaning roller 13 forms a nip (portion) N3 in contact with the controller 11. The cleaning roller 13 electrically removes the toner remaining on the developing roller after passing through the developing position G by, and in addition, removes the carrier liquid remaining on the developing roller by application of pressure. The cleaning roller 13 is capable of removing the toner from the developing roller 11 by application of a removing voltage, which is a potential difference of, for example, +200 V between the cleaning roller 13 and the developing roller 11, by a cleaning voltage source V3. Further, to the cleaning roller 13, an ammeter 30 is connected. The ammeter 30 as a current detecting portion detects a current flowing through between the developing roller 11 and the cleaning roller 13. A current value of the ammeter 30 fluctuates depending on an amount of the toner reaching the nip N3.

The toner removed by the cleaning roller 13 is collected from the cleaning roller 13 by a blade member 15 having the same potential as the cleaning roller 13. The blade member 15 is formed by stainless steel (SUS), for example. Further, hardness of the blade member 15 may only be required to be equal to or lower than hardness of the cleaning roller 13. The toner and the carrier liquid which are removed by the cleaning roller 13 are returned together with the liquid developer which did not pass through the nip N1, into a mixer 20 as an accommodating container by an unshown pump.

To the developer container 10, the mixer 20 in which the liquid developer is accommodated is connected. The mixer 20 is capable of supplying a liquid developer, generated by mixing and dispersing the toner in the carrier liquid at a predetermined ratio, into the developer container 10 by an unshown pump. Toner for supply is accommodated in a toner tank 21 and a carrier liquid for supply is accommodated in a carrier tank 22, respectively. In the carrier tank 22, the carrier liquid for supply which is relatively higher in resistivity than the liquid developer circulating between the mixer 20 and the developing device 53 is accommodated. Further, the carrier liquid or the toner is supplied from the associated tank toward the mixer 20 on the basis of a toner concentration (content) of the liquid developer detected b an unshown toner concentration sensor provided in the mixer 20. The mixer 20 mixes the supplied carrier liquid and the supplied toner and disperses the toner into the carrier liquid. Thus, the toner concentration of the liquid developer is maintained at a certain level. Further, to the mixer 20, a supplying device 23 as a supplying means for supplying the charge control agent is connected, so that the charge control agent is supplied as needed (see FIG. 5 described later). The toner in the liquid developer increases in toner charge amount with the supply of the charge control agent.

[Controller]

Figure 3:
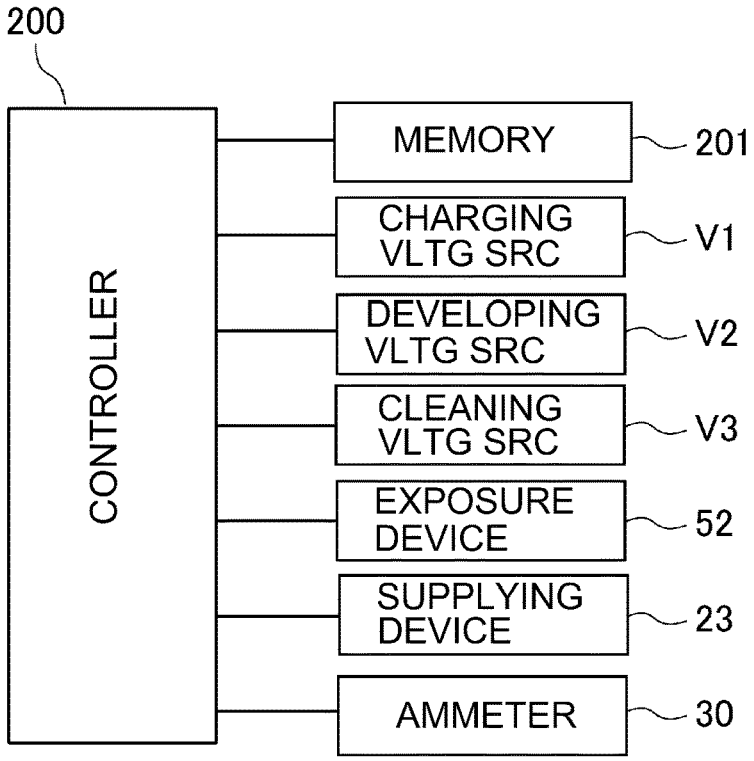
FIG. 3 is a control block diagram showing a setting control system of a developing contrast.

As shown in FIGS. 1 and 2, the image forming apparatus 100 of this embodiment includes a controller 200. The controller 200 will be described using FIG. 3 while making reference to FIGS. 1 and 2. However, in FIG. 3, a control system of the developing contrast is shown, and to an actual controller 200, in addition to the illustrated members, various devices such as motors and voltage sources and the like for operating the image forming apparatus 100 are connected, but, here these members are not the main object of the present invention and therefore are omitted from illustration and description.

The controller 200 as a control means carries out various pieces of control of the image forming apparatus 100, such as an image forming operation, and includes a CPU (Central Processing Unit) omitted from illustration. To the controller 200, a memory 201 as a storing means, such as an ROM, an RAM or a hard disk device is connected. In the memory 201, various programs, data and the like for controlling the image forming apparatus 100 are stored. The controller 200 executes an image forming job stored in the memory 201 and is capable of causing the image forming apparatus 100 to carry out image formation. In the case of this embodiment, the controller 200 is capable of executing setting control (setting mode) for setting the developing contrast to be used during image formation. The setting control of the developing contrast will be described later (see FIG. 5). Further, in the memory 201, a plurality of developing voltage values, predetermined coefficient (see FIG. 5 described later), a setting table (see FIG. 8 and Table 1 described later), current values corresponding to developing contrasts set by the setting control, and the like which are used during the setting control are stored. Incidentally, in the memory 201, calculation process results with execution of various control programs, and the like are capable of being temporarily stored.

The image forming job is a series of operations from a start of the image formation until the image forming operation is completed, on the basis of a print signal for forming the image on the recording material. That is, the image forming job is a series of operations from a start of a preparatory operation (so-called a pre-rotation operation) required for carrying out the image formation until a preparatory operation (so-called a post-rotation) required for ending the image formation through the image forming step. Specifically, the image forming job refers to the operations from the time of the pre-rotation (preparatory operation before the image formation) after receiving the print signal (reception of the image forming job) to the post-rotation (operation after the image formation), and includes an image forming period and a sheet interval.

Herein, during non-image formation is the time, when a forming operation of the image formed on the recording material is not carried out, such as during the pre-rotation, during the post-rotation, the sheet interval or the like, for example. During the pre-rotation is a period from a start of rotations of the photosensitive drum 50 and the intermediary transfer drum 60 and the like without forming the toner image upon receipt of a print signal at the time of a start of image formation until exposure of the photosensitive drum 50 to light is started. During the post-rotation is a period from an end of final image formation of the image forming job until rotations of the photosensitive drum 50 and the intermediary transfer drum 60 and the like which are continuously rotated without forming the toner images are stopped. Further, the sheet interval is a period between an image region and an image region each corresponding to the recording material S, and in the case where various pieces of control are carried out during this sheet interval, the period of the sheet interval is also appropriately prolonged in some cases.

To the controller 200, in addition to the memory 201, the charging voltage source V1, the developing voltage source V2, the cleaning voltage source V3, the exposure device 52, the supplying device 23 and the ammeter 30 are connected via unshown interfaces. The controller 200 controls the charging voltage source V1 and causes the charging voltage source V1 to apply a DC voltage to the charging roller 51, so that the photosensitive drum surface is charged to a predetermined potential. The controller 200 controls the exposure device 52 and causes the exposure device 52 to expose the photosensitive drum surface to light, so that the electrostatic latent image is formed on the photosensitive drum. The controller 200 controls the developing device V2 and causes the developing voltage source V2 to apply the developing voltage to the developing roller 11, so that the electrostatic latent image is developed into the toner image. At this time, the controller 200 controls the developing voltage source V2, so that the developing contrast can be changed. The controller 200 controls the cleaning voltage source V3 and causes the cleaning voltage source V3 to apply a discharging voltage to the cleaning roller 13, so that the toner on the developing roller is removed. Then, the controller 200 is capable of acquiring a current value detected by the ammeter 30. The controller 200 controls the supplying device 23 and causes the supplying device 23 to supply the charge control agent to the mixer 20.

Incidentally, in the case where the electrostatic latent image on the photosensitive drum is developed into the toner image, as has already been described above, when the developing contrast is increased, development efficiency becomes high, so that a developing property can be enhanced. Here, the development efficiency is a ratio of use of the toner on the developing roller before and after the electrostatic latent image is developed into an image with a print ratio of 100%. That is, development efficiency of 100% refers to the case where the toner does not remain on the developing roller after the electrostatic latent image is developed into the image with the print ratio of 100%. Further, development efficiency of 95% refers to that 95% of the toner on the developing roller is used for development in a period before and after the electrostatic latent image is developed into the image with the print ratio of 100%. This is because as the electric charge of the toner and an electric field exerted on the liquid developer during development, i.e., the DC are larger, mobility of the toner in the liquid developer becomes high, i.e., the toner becomes easier to move in the liquid developer. That is, in general, mobility of charged particles in the liquid developer can be represented by Stokes' formula as shown in the following formula 1. In the formula 1, a moving speed of the charged particles is represented by "v", an electric field exerted on the liquid developer is represented by "E", an electric charge of the charged particles is represented by "Q", viscosity of the liquid developer is "η", and an average radius of the charged particles is represented by "α".

$$u=|v|/|E|=Q/(6\pi\eta\alpha) \qquad \text{formula 1}$$

From the formula 1, it can be understood that as the electric charge (Q) of the toner or the developing contrast having the influence on the electric field (E) exerted on the liquid developer is larger, the mobility of the toner in the liquid developer becomes higher. Further, the toner charge amount depends on a surface area ($4\pi\alpha^2$) of the toner, and therefore, the mobility of the toner is higher than a larger particle size of the toner. In the case of this embodiment, the mobility of the toner is $5.0\times10^{-8}$–$5.0\times10^{-10}$ ($m^2/(V\cdot s)$). The resistivity of the liquid developer is $5.0\times10^{-8}$–$5.0\times10^{-12}$ ($\Omega\cdot cm$). Incidentally, the mobility of the toner also changes depending on a content of the charge control agent in the liquid developer, or a temperature or the like. Further, a resistance value of the liquid developer changes depending on a content of the toner in the liquid developer, or a temperature or the like.

Figure 4:
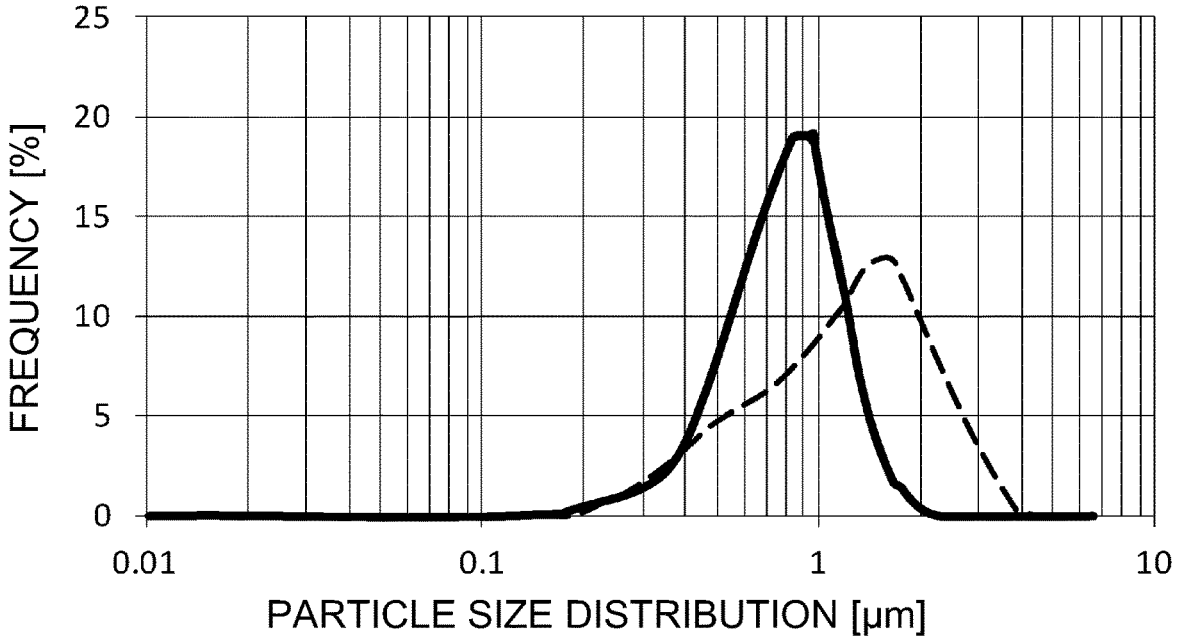
FIG. 4 is a graph showing a particle size distribution of toner in a liquid developer before development and a particle size distribution of the toner in the liquid developer moved to a photosensitive drum with the development.

As has already been described above, in the case where the development of the electrostatic latent image into the toner image is not carried out with the development efficiency closer to 100%, with progress of the image formation, a ratio of the toner with a small particle size increases in the liquid developer which circulates between the mixer 20 and the developing device 53. Here, the development efficiency closer to 100% refers to the case of the development efficiency of 90% or more. In FIG. 4, a particle size distribution of the toner in the liquid developer before the development (represented by a solid line) and a particle size distribution of the toner moved from the developing roller 11 to the photosensitive drum 50 with the development (represented by a broken line) are shown. However, in FIG. 4, the case where the developing contrast is set at 50 (V) and the development efficiency is 65-70% was shown as an example. Incidentally, for measurement of the particle size distributions, "Nanotrac Wave" (registered trademark, manufactured by Microtrac BEL Corp.) was used.

As can be understood from FIG. 4, as regards the toner moved from the developing roller 11 to the photosensitive drum 50 during the development, a ratio of the toner having a large particle size in the toner contained in the liquid developer before the development is large. This shows, as described above, that the mobility of the toner is higher with the larger particle size of the toner and that such toner high in mobility is moved from the developing roller 11 to the photosensitive drum 50 in preference to toner low in mobility (i.e., small in particle size).

Localization due to the particle size occurs on such toner moved from the developing roller 11 to the photosensitive drum 50 during the development, so that with progress of the image formation, a median value (D50) of the particle size distribution of the toner in the liquid developer in the mixer changes. Specifically, a ratio of the toner low in mobility, i.e., smaller in particle size, increases. However, as has already been described above, when the ratio of the toner small in particle size excessively increases, even when the toner concentration of the liquid developer is appropriate and even when the toner amount in the liquid developer is sufficient, the electrostatic latent image is liable to be developed into the toner image low in image density. Then, a user discriminates that the liquid developer reaches an end of a lifetime thereof from a viewpoint of a deficiency of the concentration irrespective of the liquid developer which is still usable, and can replace the liquid developer, i.e., exchange the liquid developer.

In view of the above point, in this embodiment, the developing contrast at which the electrostatic latent image can be developed into the toner image with high development efficiency where toners with most particle sizes contained in the liquid developer are capable of being used is set. In other words, the development was enabled without almost changing the particle size distribution (D50) of the toner in the liquid developer before and after the development.

[Setting Control of Developing Contrast]

Figure 5:
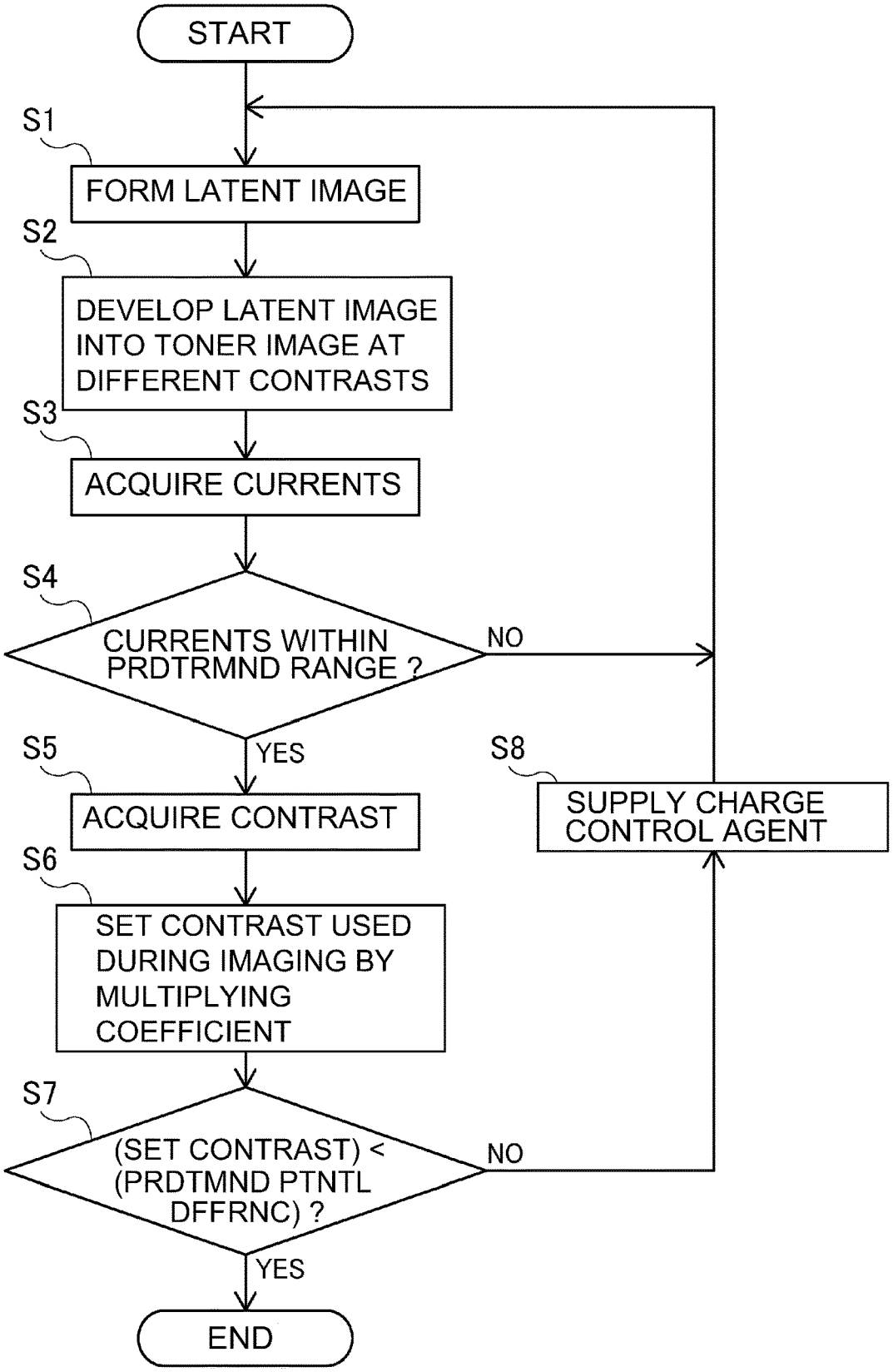
FIG. 5 is a flowchart showing setting control in a First Embodiment.

In the following, setting control of the developing contrast in this embodiment will be specifically described using FIG. 5 to FIG. 7 while making reference to FIG. 2. In FIG. 5, the setting control in the First Embodiment is shown. The controller 200 executes the setting control (setting mode) during non-image formation. That is, the controller 200 is capable of executing the setting control during post-processing of an image forming job, in a sheet interval every 5,000 sheets or during pre-processing of a subsequent image forming job or the like.

As shown in FIG. 5, the controller 200 causes, during the setting mode, the exposure device 52 to form an electrostatic latent image for detection on the charged photosensitive drum 50 (S1). The electrostatic latent image for detection for forming a toner image for detection is an electrostatic latent image for forming an output image (solid image) of 100% in print ratio, for example. The controller 200 controls the developing voltage source V2, so that the formed electrostatic latent image for detection is developed and formed into the toner image for detection (S2). At this time, the controller 200 carries out development in accordance with a developing voltage value stored in the memory 201 in advance. The controller 200 acquires a current value of a current, from the ammeter 30, flowing when a developing region of the developing roller 11 in which the electrostatic latent image for detection is developed, i.e., a region where the toner is moved to the photosensitive drum 50 with the development of the electrostatic latent image at the developing position G reaches the nip N3 (S3). That is, when the toner remaining in the developing region of the developing roller 11 after the development is removed by the cleaning roller 13 to which a removing voltage (predetermined voltage) is applied, the controller 200 acquires the current value detected by the ammeter 30. Then, the controller 200 repeats the above-described processes S1 to S4 until current values acquired at a plurality of developing contrasts, respectively, fall within a predetermined range (NO of S4). However, when the above-described S1 to S4 are repetitively performed, the controller 200 causes the exposure device to form the electrostatic latent images for detection having the same exposed portion potential and causes the developing device to develop the electrostatic latent images for detection at different developing contrasts depending on developing voltage values stored in the memory 201.

Figure 6:
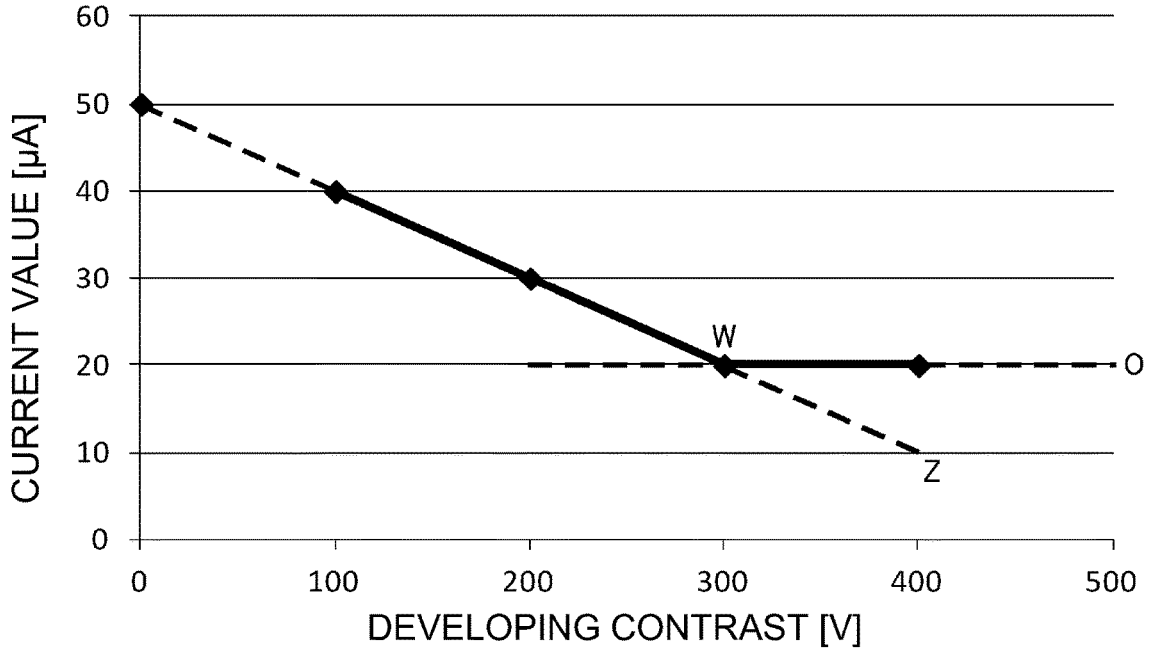
FIG. 6 is a graph showing a relationship between the developing contrast and a current flowing through a cleaning roller.

A relationship between the developing contrast and the current value acquired in the case where the electrostatic latent images for detection are developed into the toner images at the different developing contrasts in the above-described manner is shown in FIG. 6. In FIG. 6, an abscissa shows the developing contrast, and an ordinate shows the current value. FIG. 6 is an example in the case where the developing contrast is changed with a 100 V range. As can be understood from FIG. 6, until the developing contrast reaches 300 V, the current value lowers from 40 to 20 μA. This represents that the development efficiency becomes higher with an increasing developing contrast and the toner moved from the developing roller 11 to the photosensitive drum 50 increases (in amount) with the development of the electrostatic latent image for detection at the developing position G and therefore the toner which reached the nip N3 decreases (in amount). A slope of the change of the developing contrast and the current value shown in FIG. 6 varies depending on the toner mobility, so that an absolute value of the slope becomes larger with larger toner mobility. The example shown in FIG. 6 is the case where the toner mobility is $5.0\times10^{-9}$ ($m^2/(V\cdot s)$), and in that case, the slope was −10 ($m^2/(V\cdot s)$).

On the other hand, when the developing contrast exceeds 300 V, even when the developing contrast changes, the current value is substantially unchanged within a predetermined range (here at a certain value of 20 μA). This represents that the development efficiency increases up to near 100% and most of the toner is moved from the developing roller 11 to the photosensitive drum 50 with the development of the electrostatic latent image for detection at the developing position G, and therefore, the toner reaching the nip N3 almost becomes non-existent. When the development efficiency becomes high up to near 100%, even if the developing contrast is made larger thereafter the development efficiency cannot be made higher, and therefore, the current value is substantially unchanged. Incidentally, the current value (target current value) when the slope is "0" varies depending on a resistance value of the liquid developer. The example shown in FIG. 6 is the case where resistivity of the liquid developer is $5.0\times10^{-10}$ (Ω·cm).

Returning to description of FIG. 5, in the case where the current values acquired at the plurality of developing contrasts fall within the predetermined range (YES of S4), the controller 200 acquires the developing contrast at which the current value in the predetermined range can be obtained (S5). However, at that time, the controller 200 acquires a minimum developing contrast of those at which the current values fall within the predetermined range. For example, as shown in FIG. 6, linear approximation Z of two points or more different in current value and linear approximation 0 of two points or more at which the current values fall within the predetermined range are acquired, and a developing contrast at a point of intersection W where these linear approximations cross each other is taken as a minimum developing contrast. Then, the controller 200 multiplies the acquired minimum developing contrast by predetermined coefficient stored in the memory 201, and sets a resultant value at a developing contrast to be used during image formation (S6). The controller 200 changes the developing voltage in accordance with the set developing contrast.

The above-described predetermined coefficient is coefficient larger than 1, and may preferably be a range of "1.01 to 1.1", for example. As an example, as shown in FIG. 6, the minimum developing contrast at which the current value is constant at "20 μA" is "300 V", and in the case where the predetermined coefficient is "1.1", the developing contrast to be used during image formation is set at "330 V". The reason why the above-described predetermined coefficient is used is that the developing contrast is acquired by the linear approximation as described above. That is, as regards the developing contrast acquired by the linear approximation, it is possible that an actual current value does not fall within the predetermined range. Therefore, in order to acquire the developing contrast at which the current value falls within the predetermined range, the above-described predetermined efficiency is used, so that a margin is ensured on a side higher than the developing contrast acquired by the linear approximation.

Further, in this embodiment, the minimum developing contrast is acquired. This is because a so-called fog-removing potential which is a potential difference between the dark portion potential of the photosensitive drum 50 and the developing voltage becomes lower with an increasing developing contrast and the toner is liable to be deposited on a non-exposed portion of the photosensitive drum 50. Incidentally, the fog-removing potential may preferably be ensured at a certain potential (for example, 200 V in absolute value) even when the developing contrast is changed. Therefore, for example, in the case where the developing contrast to be used during image formation is set at "330 V", the photosensitive drum 50 may preferably be charged to the dark portion potential of "−530 V" during image formation.

The controller 200 discriminates whether or not the developing contrast set in the above-described manner is smaller than a predetermined potential difference (for example, 400 V) (S7). For example, in the case where a maximum potential (absolute value) of the dark portion potential at which the photosensitive drum 50 is chargeable by the charging roller 51 is 600 V, the developing contrast is restricted to a potential difference smaller than 400 V. This is because when the developing contrast is set at 400 V or more, from a relationship with the maximum potential of the dark portion potential at which the photosensitive drum 50 is chargeable by the charging roller 51, the above-described fog-removing voltage is only 200 V or less, with the result that the toner is liable to be deposited on the non-exposed portion of the photosensitive drum 50.

In the case where the set developing contrast is smaller than the predetermined potential difference (YES of S7), the controller 200 ends this setting control. On the other hand, in the case where the set developing contrast is not less than the predetermined potential difference (NO of S7), the controller 200 causes the supplying device 23 to supply the charge control agent (S8). That is, in this case, from a relationship of the above-described fog-removing voltage, it is difficult to use the developing contrast set during image formation. Therefore, the charge control agent is supplied by a predetermined amount per (one) occurrence so that the charge control agent is increased to a weight ratio of, for example, 0.3%, so that the charge amount of the toner in the liquid developer, i.e., the toner mobility is made high. Thereafter, the controller 200 returns to the process of the above-described S1 and executes the processes of S1 to S7 again. Thus, by increasing the toner mobility through the supply of the charge control agent, compared with before the supply of the charge control agent, a possibility that the developing contrast set by the above-described process is settable at the predetermined potential difference or less can be enhanced.

Incidentally, although illustration is omitted, in the case where the set developing contrast is not the potential difference or less although the charge control agent is supplied until the amount thereof reaches, for example, 0.3% in weight ratio, the controller 200 may preferably cause an unshown display portion to display an error display prompting exchange of the liquid developer. For example, in the case of a new liquid developer in which a particle size distribution "D5" of the toner is 0.5 μm, a particle size distribution "D50" of the toner is 0.9 μm and a particle size distribution "D95" of the toner is 1.8 μm, when the particle size distribution "D50" lowers to 0.5 μm, the exchange of the liquid developer is needed.

The present inventors conducted an experiment in which the case where the images are formed at the development efficiency of about 80% without making the above-described setting control (comparison example) and the case where the images are formed at the development efficiency of about 97% with execution of the above-described setting control (this embodiment) are compared with each other. In this experiment, in the case where the images are formed on A4-size recording materials with an image ratio of 15%, for each of image formation of 100 sheets and subsequent image formation of 200 sheets, a particle size distribution of the toner in the liquid developer accommodated in the mixer 20 was measured. In FIG. 7, experimental results are shown. In FIG. 7, the experimental result in the case where the images are formed at the development efficiency of about 80% was represented by a dotted line, and the experimental result in the case where the images are formed at the development efficiency of about 97% was represented by a solid line.

Figure 7:
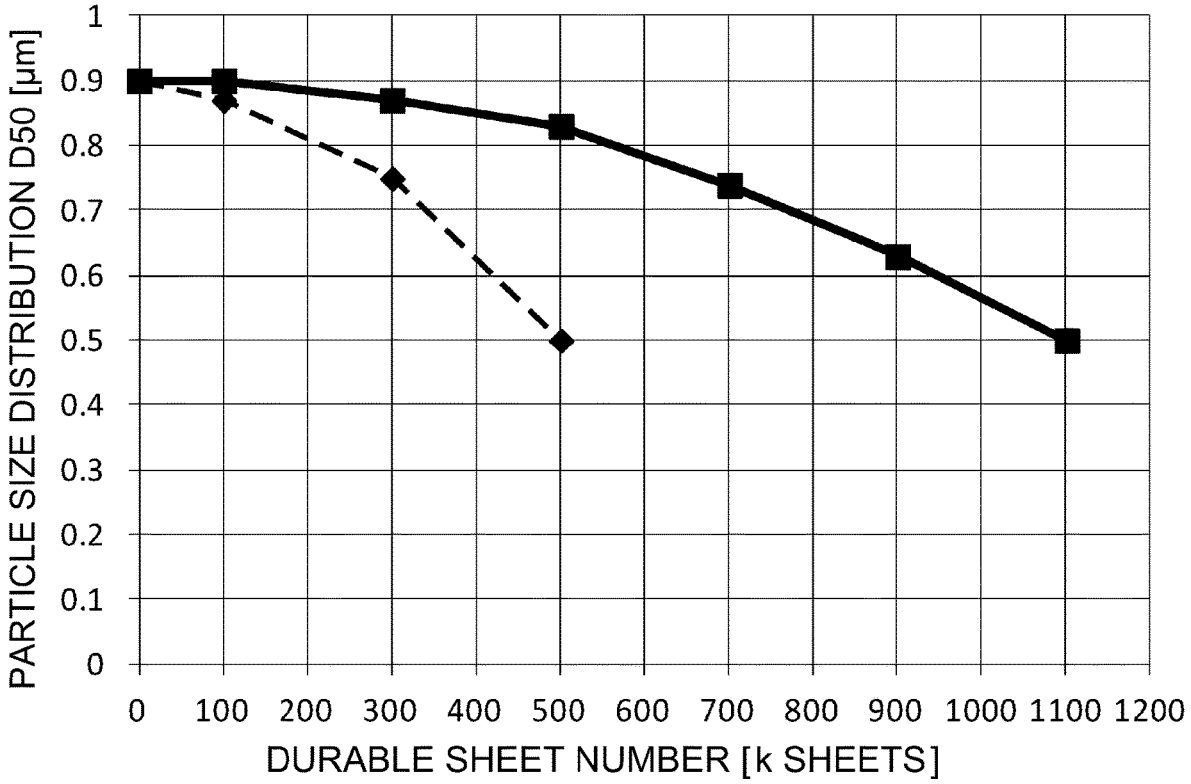
FIG. 7 is a graph showing an experimental result of this embodiment and a comparison example.

As can be understood from FIG. 7, in the case of the comparison example, when the images are formed on 500,000 sheets of recording materials, the particle size distribution (D50) of the toner lowered to 0.5 μm which is an exchange standard of the liquid developer. On the other hand, in the case of this embodiment, until the images are formed on 1,100,000 sheets of recording materials, the particle size distribution (D50) of the toner did not lower to 0.5 μm which is the exchange standard. Therefore, in the case of the comparison experiment, the exchange of the liquid developer is needed every 500,000 sheets, but in the case of this embodiment, only the exchange of the liquid developer every 1,100,000 sheets which is not less than twice the 500,000 sheets.

As described above, in this embodiment, the plurality of electrostatic latent images for detection formed by changing the developing contrast are developed into toner images, and current values fluctuated by the amount of the toner remaining on the developing roller 11 after the development of the electrostatic latent images are actually measured. Then, the developing contrast to be used during image formation is set by utilizing that the current value becomes small with a decreasing amount of the toner in the case where the development efficiency is high compared with the case where the development efficiency is low. In this embodiment, the developing contrast at which the current value falls with the predetermined range since the development efficiency reaches an almost upper limit is set at the developing contrast to be used during image formation. Thus, in this embodiment, the development is carried out at the set developing contrast, whereby the electrostatic latent images can be developed into the toner images while maintaining high development efficiency. At the high development efficiency, toners with many particle sizes including large and small particle sizes contained in the liquid developer are subjected to development, and a ratio of the toner with the small particle size is not excessively increased, so that it is possible to suppress that the electrostatic latent images are developed into the toner images with a low image density. Further, the particle size distribution (D50) of the toner does not readily lower to a degree which is the exchange standard of the liquid developer, so that an exchange cycle of the liquid developer can be prolonged.

Second Embodiment

In the case of the above-described First Embodiment, the minimum developing contrast of those at which the current value falls within the predetermined range was acquired from the point of intersection W between the linear approximation Z of the two points or more different in current value and the linear approximation O of the two points or more where the current values fall within the predetermined range (see FIG. 6), but is not limited thereto. For example, the above-described minimum developing contrast may also be acquired from the linear approximation Z of the two points or more different in current value and a setting table which has already been stored in the memory 201 and which will be described later. Such setting control in the Second Embodiment will be described using FIG. 8 while making reference to FIG. 1 and FIG. 2. However, here, a process different from the setting control in the First Embodiment shown in FIG. 5 will be principally described.

Figure 8:
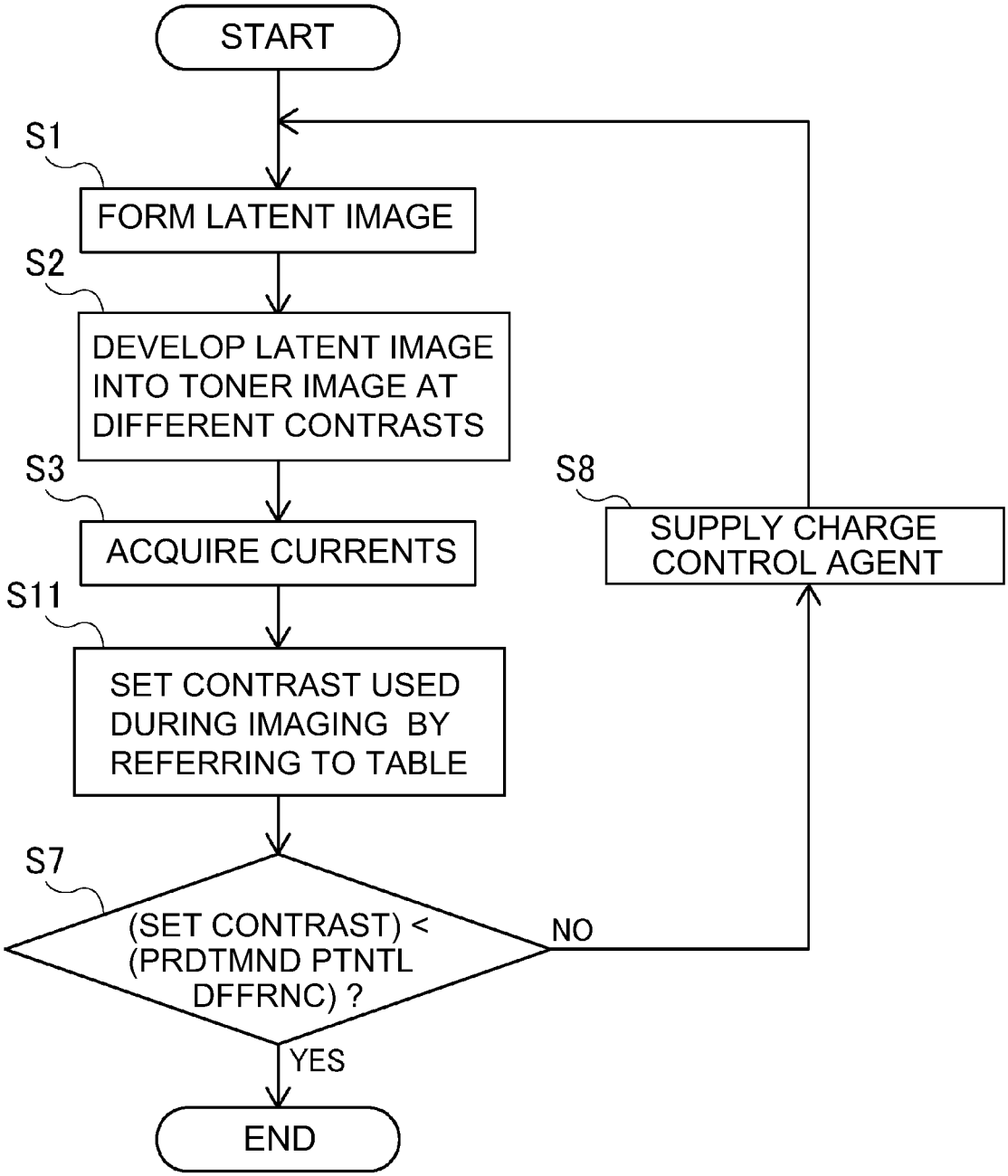
FIG. 8 is a flowchart showing setting control in a Second Embodiment.

As shown in FIG. 8, the controller 200 causes the exposure device to develop the electrostatic latent image for detection into the toner image (S2). Then, the controller 200 acquires the current value, from the ammeter 30, of the current flowing when the developing region of the developing roller 11 reached the nip N3 (S3). However, in this embodiment, it may only be required that the electrostatic latent images for detection are developed into the toner images at different developing contrasts where at least two different current values are acquired and that the linear approximation Z of the two points or more different in current value as shown in FIG. 6 can be obtained. That is, different from the First Embodiment, in order to obtain the linear approximation O of the two points or more where the current values fall within the predetermined range, there is no need to develop the electrostatic latent images for detection into the toner images. In this case, the controller 200 may only be required to cause the developing device to develop the electrostatic latent images for detection into the toner images at least two times in a range of the developing contrast of less than 150 V, which is a range in which the slope of the change of the developing contrast and the current value is not "0" as shown in FIG. 6, for example.

The controller 200 sets the developing contrast to be used during image formation by making reference to the setting table which has already been stored in the memory 201 (S11). The setting table is shown in Table 1. Table 1 is data in which the slope of the above-described linear approximation 0, i.e., the slope of the developing contrast and the contact value is associated with a predicted value of the developing contrast at which the current value is in the predetermined range, for each slope. The predicted value of the developing contrast is a potential difference providing a current value (target current value) at which the current value falls within the predetermined range in the case where the electrostatic latent images for detection are developed into the toner images by tentatively changing the developing contrast.

TABLE 1

| Slope | Developing contrast [V] |
|---|---|
| 0 to −5 | −430 |
| −6 to −10 | −330 |
| −11 to −15 | −275 |
| −16 to −20 | −245 |

In the relationship between the developing contrast and the current flowing through the cleaning roller shown in FIG. 6, a range in which the slope is a negative value represents that the development efficiency becomes higher with an increasing developing contrast and that the toner remaining in the developing region of the developing roller 11 after the development becomes small in amount. Further, a magnitude of the slope represents that the magnitude of the slope is proportional to the toner mobility as described above, i.e., that the toner mobility is larger with a larger slope (absolute value). Here, the developing contrast at which high development efficiency can be obtained is roughly determined depending on this slope. Therefore, in the case of this embodiment, setting of the developing contrast to be used during image formation was made on the basis of the magnitude of this slope. For example, in the case where the relationship of FIG. 6 holds, the slope of the change of the developing contrast and the current value is −10 ($m^2/(V \cdot s)$), so that the developing contrast is set at "−330 V" in accordance with Table 1.

The controller 200 discriminates whether or not the developing contrast set in the above-described manner is smaller than a predetermined potential difference (for example, 400 V) (S7). In the case where the set developing contrast is smaller than the predetermined potential difference (YES of S7), the controller 200 ends this setting control. On the other hand, in the case where the set developing contrast is not less than the predetermined potential difference (NO of S7), the controller 200 causes the supplying device 23 to supply the charge control agent (S8) and repeats the above-described processes S1 to S3 and S11.

As described above, in this embodiment, the electrostatic latent images for detection are developed into the toner images at the different developing contrast providing at least two points of the different current values, so that the resultant value can be set at the developing contrast to be used during image formation. Accordingly, in this embodiment, an effect similar to the effect of the above-described First Embodiment such that a lowering in productivity of the image forming apparatus 100 is suppressed and in addition, the electrostatic latent images can be developed into the toner images while maintaining the high development efficiency and thus it is possible to suppress that the electrostatic latent images are developed into the toner images with the low image density can be obtained.

OTHER EMBODIMENTS

Figure 9:
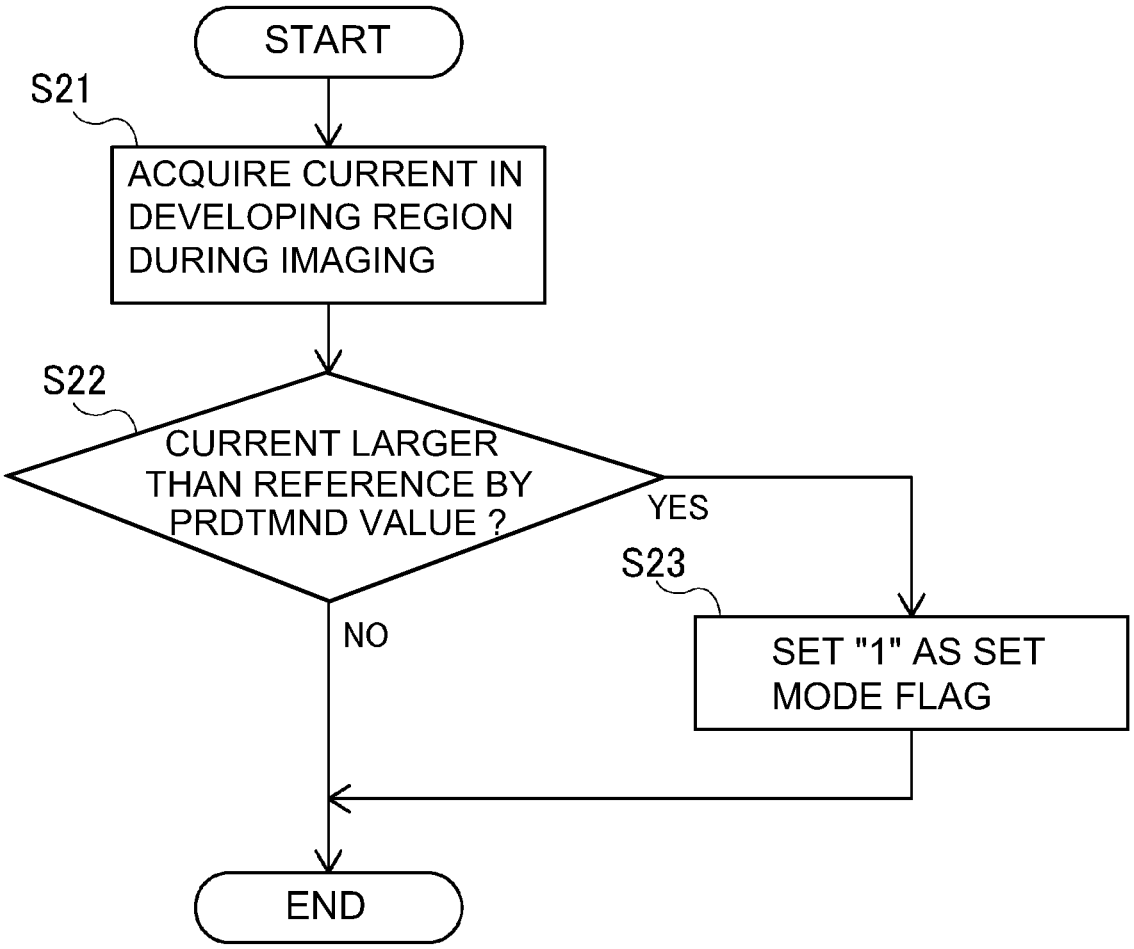
FIG. 9 is a flowchart showing determination control for determining execution propriety of the setting control.

In the above-described First Embodiment and Second Embodiment, the above-described setting control (see FIG. 5 or FIG. 8) is executed in the case where image formation is carried out, for example, every 5,000 sheets, but is not limited thereto. The controller 200 may also determine execution propriety of the above-described setting control on the basis of the current value detected by the ammeter 30 during image formation, for example. Determination control for determining the execution propriety of this setting control will be described using FIG. 9 while making reference to FIG. 1 and FIG. 2. In FIG. 9, an example of the determination control is shown. The controller 200 executes the determination control shown in FIG. 9 in synchronism with a start of the execution of an image forming job.

As shown in FIG. 9, the controller 200 acquires a current value detected by the ammeter 30 when the toner remaining in the developing region of the developing roller 11 after the development during image formation is removed by the cleaning roller 13 (S21). The controller 200 acquires the current value detected when particularly the image (solid image) of 100% in print ratio is formed. The print ratio of the image at the developing position G at certain timing can be acquired depending on how many image signals are used in a single image forming operation in accordance with a pixel number (video count value) of an output image used during the exposure by the exposure device 52. The video count value is an integrated value in the case where a level (0-255 levels) of an inputted image signal for (one) pixel is integrated for one sheet surface of the output image. Incidentally, acquisition of the above-described current value may also be repetitively carried out at timing during image formation, for any of each of 1-2500 sheets, for example. Further, in the image forming job, in the case where the images of 100% in print ratio are not formed, the controller 200 may also acquire the above-described current values by forming the images of 100% in print ratio in the sheet interval.

The controller 200 compares the detected current value with a predetermined reference value and discriminates whether or not the detected current value is larger than the reference value by a predetermined value (for example, a difference is +5% or more) (S22). The reference value is a current value (for example, 20 μA) corresponding to the developing contrast set when the above-described setting control (see FIG. 5 or FIG. 8) is executed in advance. In the case where the detected current value is for example +5% or more the reference value (YES of S22), the controller 200 sets a setting mode execution flag at "1" (S23). On the other hand, in the case where the detected current value is not for example +5% or more the reference value (NO of S22), the controller 200 does not set the setting mode execution flag at "1". The setting mode execution flag is a flag showing the execution propriety of the above-described setting control (see FIG. 5 or FIG. 8).

The controller 200 determines the execution propriety flag set by the above-described determination control during post-rotation of the image forming job during execution, in a sheet interval every predetermined number of sheets, or during pre-processing of a subsequent image forming job or the like. That is, only in the case where the execution flag is set at "1" by the above-described determination control, the controller 200 executes the above-described setting control at predetermined timing such as during the post-processing or in the sheet interval of the image forming job or during the pre-processing of the subsequent image forming job. By doing so, it is preferable that the lowering in productivity of the image forming apparatus 100 can be suppressed. Incidentally, in the case where the above-described setting control is executed, the controller 200 resets the setting mode execution flag to "0".

Incidentally, in the above-described embodiments, in order to supply the charge control agent to the liquid developer in the mixer 20, the supplying device 23 in which the charge control agent is accommodated was used, but the present invention is not limited thereto. For example, the supply of the charge control agent may also be carried out by supplying the carrier liquid containing the charge control agent into the mixer 20. Further, also as regards the supply of the toner, the supply of the toner may also be carried out by supplying the carrier liquid containing the toner into the mixer 20.

Incidentally, in the above-described embodiments, a constitution in which the intermediary transfer drum was used as the intermediary transfer member was described, but the intermediary transfer member may also be, for example, an intermediary transfer belt formed in an endless belt shape.

INDUSTRIAL APPLICABILITY

According to the present invention, there is provided an image forming apparatus of an electrophotographic type in which an image is formed with the liquid developer.

EXPLANATION OF SYMBOLS

11 . . . developer carrying member (developing roller), 13 . . . cleaning means (cleaning roller), 20 . . . accommodating container (mixer), 23 . . . supplying means (supplying device), 30 . . . current detecting means (ammeter), 50 . . . image bearing member (photosensitive drum), 51 . . . charging means (charging roller), 52 . . . exposure means (exposure device), 100 . . . image forming apparatus, 200 . . . control means (controller), S . . . recording material, V2 . . . voltage applying means (developing voltage source)

The invention claimed is:

1. An image forming apparatus comprising:

a rotatable image bearing member;

a developer carrying member, rotatable while carrying a liquid developer containing toner and a carrier liquid, for developing an electrostatic image formed on said image bearing member with the liquid developer by application of a developing voltage;

a cleaning member capable of removing the toner, remaining on said developer carrying member after development, by application of a voltage in contact with said developer carrying member;

a current detecting portion for detecting a current flowing between said developer carrying member and said cleaning member; and a controller capable of executing, during non-image formation, a mode in which the current flowing between said developer carrying member and said cleaning member and applied with a predetermined voltage to said cleaning member is detected by said current detection portion for each of a plurality of toner images when a region on said developer carrying member, on which an electrostatic image is developed to form each of the plurality of toner images which are made different in a potential difference between the developing voltage and an image portion potential on said image bearing member, passes through said cleaning member, and the potential difference to be used during image formation between the developing voltage and the image portion potential is set on the basis of a value of the detected current for each of the plurality of toner images, and wherein in the mode said controller sets the potential difference to be used during image formation between the developing voltage and the image portion potential so that an absolute value of the potential difference to be used during image formation between the developing voltage and the image portion potential is larger than the potential difference between the developing voltage and the image portion potential whose absolute value is smallest among the potential differences between the developing voltage and the image portion potential to be used for developing a toner image of which the value of the current detected is in a predetermined range among the plurality of toner images.

2. An image forming apparatus according to claim 1, wherein said controller sets the potential difference to be used during image formation between the developing voltage and the image portion potential by constituting the developing voltage on the basis of the value of the current.

3. An image forming apparatus according to claim 1, wherein said controller sets the potential difference to be used during image formation between the developing voltage and the image portion potential in a range in which an absolute value of the potential difference between the developing voltage and the image portion potential is smaller than a predetermined potential difference.

4. An image forming apparatus according to claim 1, comprising, an accommodating container for accommodating the liquid developer supplied to and carried on said developer carrying member, and a supplying portion for supplying a charge control agent to the liquid developer accommodated in said accommodating container, wherein said controller causes said supplying portion to supply the charge control agent in a case where an absolute value of the potential difference between the developing voltage and the image portion potential is a predetermined potential difference or more.

5. An image forming apparatus according to claim 1, wherein said controller executes the mode every predetermined number of times of image formation.

6. An image forming apparatus according to claim 1, wherein said cleaning member is a metal roller.

7. An image forming apparatus according to claim 1, comprising, a supplying portion for supplying the developer to said developer carrying member, an electrode portion which is provided downstream of said supplying portion with respect to a rotational direction of said developer carrying member and to which a voltage having the same polarity as a polarity of the toner and having a voltage value larger in absolute value than a value of a voltage applied to said developer carrying member, and a roller which is provided downstream of said electrode portion with respect to the rotational direction and upstream of a developing position where said developer carrying member develops an electrostatic image formed on said image bearing member is developed with respect to the rotational direction and which contacts said developer carrying member.

8. An image forming apparatus according to claim 1, wherein said controller sets the potential difference to be used during image formation between the developing voltage and the image portion potential so that a ratio of development of the electrostatic image with the toner on said developer carrying member is 90% or more.

9. An image forming apparatus according to claim 1, wherein said controller sets the potential difference between the developing voltage and the image portion potential so that the value of the current detected by said current detecting portion is a target value.

* * * * *